US005806431A

United States Patent [19]

Muth

[11] Patent Number: 5,806,431

[45] Date of Patent: Sep. 15, 1998

[54] METHOD AND APPARATUS FOR AXIALLY POSITIONING A PRINTING PLATE

[75] Inventor: Bernhard Walter Wolfgang Muth, Veitshöchheim, Germany

[73] Assignee: Koenig & Bauer-Albert Aktiengesellschaft, Wurzburg, Germany

[21] Appl. No.: 862,385

[22] Filed: May 23, 1997

[30] Foreign Application Priority Data

May 24, 1996 [DE] Germany ..... 196 20 997.8

[51] Int. Cl.[6] ..... B41L 3/02

[52] U.S. Cl. ..... 101/486; 101/415.1; 101/477; 101/DIG. 36

[58] Field of Search ..... 101/378, 382.1, 101/383, 389.1, 415.1, 477, 481, 485, 486, DIG. 36

[56] References Cited

U.S. PATENT DOCUMENTS

| | | | |
|---|---|---|---|
| 4,437,403 | 3/1984 | Greiner | 101/248 |
| 4,727,807 | 3/1988 | Suzuki et al. . | |
| 4,748,911 | 6/1988 | Kobler . | |
| 5,531,162 | 7/1996 | Iwamoto . | |
| 5,623,877 | 4/1997 | Muth | 101/477 |
| 5,671,674 | 9/1997 | Nobuta et al. . | |

FOREIGN PATENT DOCUMENTS

| | | |
|---|---|---|
| 0 229 892 | 7/1987 | European Pat. Off. . |
| 0 551 976 | 7/1993 | European Pat. Off. . |
| 0 581 212 | 2/1994 | European Pat. Off. . |
| 28 04 970 | 8/1978 | Germany . |
| 42 38 800 | 5/1994 | Germany . |
| 43 06 677 | 9/1994 | Germany . |
| 44 24 931 | 7/1995 | Germany . |
| 195 31 024 | 5/1996 | Germany . |

*Primary Examiner*—Ren Yan

*Attorney, Agent, or Firm*—Jones, Tullar & Cooper, P.C.

[57] ABSTRACT

A method and an apparatus for axially positioning a flexible plate on a surface of a cylinder, that is divided into several axially spaced segments, utilizes a plate transport arrangement to transfer plates from a plate preparation device to the plate cylinder. The plate is axially shiftable during transport and arrives at the plate cylinder in proper axial position.

7 Claims, 4 Drawing Sheets

METHOD AND APPARATUS FOR AXIALLY POSITIONING A PRINTING PLATE

FIELD OF THE INVENTION

The present invention is directed generally to a method and apparatus for axially positioning a printing plate. More particularly, the present invention is directed to a method and apparatus for axially positioning a printing plate while it is being applied to a cylinder of a rotary printing press. Most specifically, the present invention is directed to a method and apparatus for axially positioning a printing plate as the plate is being moved to a section of a plate cylinder by a conveying arrangement. The printing plate is engaged by a plate gripping and pressing device from a preliminary position at a printing plate preparation device. As the plate is transported to the plate cylinder, its axial position is finalized by the cooperation of lateral register stops and axial plate positioning devices.

DESCRIPTION OF THE PRIOR ART

In the German Patent Publication DE 28 04 970 A1 there is described a device that is used to mount and to remove printing plates from the plate cylinder or cylinders of a rotary printing press. In this prior art device, a suction member is utilized and performs a linear movement between a delivery roller and a plate cylinder. This suction member thus conveys the printing plate between the delivery roller and the plate cylinder. A positioning table is located intermediate the delivery roller and the plate cylinder. The suction member deposits the printing plate on the delivery table as an intermediate step in the plate transfer path from the delivery roller to the plate cylinder. The plate is positioned while it is supported by the positioning table. Once the printing plate has been positioned by the positioning table, it will again be engaged by the suction member and will be conveyed on to the plate cylinder.

A limitation of this prior art device is that the positioning of the plate can be adversely affected as the plate is picked up off the positioning table by the suction member. Even though the plate may have been properly positioned on the positioning table, it may still arrive at the plate cylinder in an improper position due to errors that may have resulted from the re-engagement of the plate by the suction transfer device. Once the printing plate has left the positioning table, it cannot be again adjusted or positioned during its transport to the printing cylinder.

It will thus be seen that a need exists for a method and apparatus that will allow for the accurate axial positioning of a printing plate on a plate cylinder of a rotary printing press. The method and apparatus in accordance with the present invention provides such a process and a device and is a significant improvement over the prior art.

SUMMARY OF THE INVENTION

It is an object of the present invention to provide a method and apparatus for axially positioning a printing plate.

Another object of the present invention is to axially position a printing plate while it is being applied to a plate cylinder of a rotary printing press.

A further object of the present invention is to provide a method and apparatus for axially positioning a printing plate while it is being conveyed to a predetermined section of the plate cylinder by a plate gripping and pressing conveying device.

As will be discussed in detail in the description of the preferred embodiments which is set forth subsequently, the method and apparatus for axially positioning a printing plate on a plate cylinder of a rotary printing press, in accordance with the present invention utilizes a plurality of lateral register stops, each of which is adjustable. The printing plate is positioned on a printing plate preparation device and is engaged by a plate gripping and pressing device. The printing plate is transported to a set position in the plate cylinder, which is selected from a plurality of possible preselectable positions. A position of the printing plate in the axial direction of the plate cylinder, in relation to a reference position on the cylinder is then determined. The printing plate is brought into its preselected set position by being positioned as it moves from the plate preparation device to the plate cylinder.

It is possible, in an advantageous manner, to position a printing plate in various positions with an exact register on the plate cylinder by means of the process or the device of the present invention.

By means of this, it is possible to compensate for the so-called "fan-out" phenomenon. The axial register deviation of an image point from print position to print position on a web of material to be printed in multicolor printing is called the "fan-out" phenomenon. This register deviation is a function, for example, of the gram weight and the properties (penetration behavior, type) of the paper web, the type of the subject to be printed and the printing speed. The result of this is that axial registry deviations can be of different sizes with different print jobs. To be able to compensate for these deviations, lateral register stops associated with printing plates, which lie axially next to each other, were appropriately adjusted up to now.

By means of the device in accordance with the present invention it is possible to preselect different positions by remote control and to position the printing plate on the cylinder accordingly. Expensive manual adjustment work on the lateral register stops is avoided by this.

If a reference point for detecting the position of the printing plate is disposed on the cylinder, inaccuracies as a result of the conveyance of the printing plate by the conveying means are reduced. Thus the method and apparatus for axially positioning a printing plate, in accordance with the present invention overcomes the limitations of the prior art and is a substantial advance in the art.

BRIEF DESCRIPTION OF THE DRAWINGS

While the novel features of the method and apparatus for axially positioning a printing plate on a plate cylinder of a rotary printing press are set forth with particularity in the appended claims, a full and complete understanding of the invention may be had by referring to the detailed description of the preferred embodiments, as presented subsequently, and as illustrated in the accompanying drawings, in which:

DETAILED DESCRIPTION OF THE PREFERRED EMBODIMENTS

Figure 1:
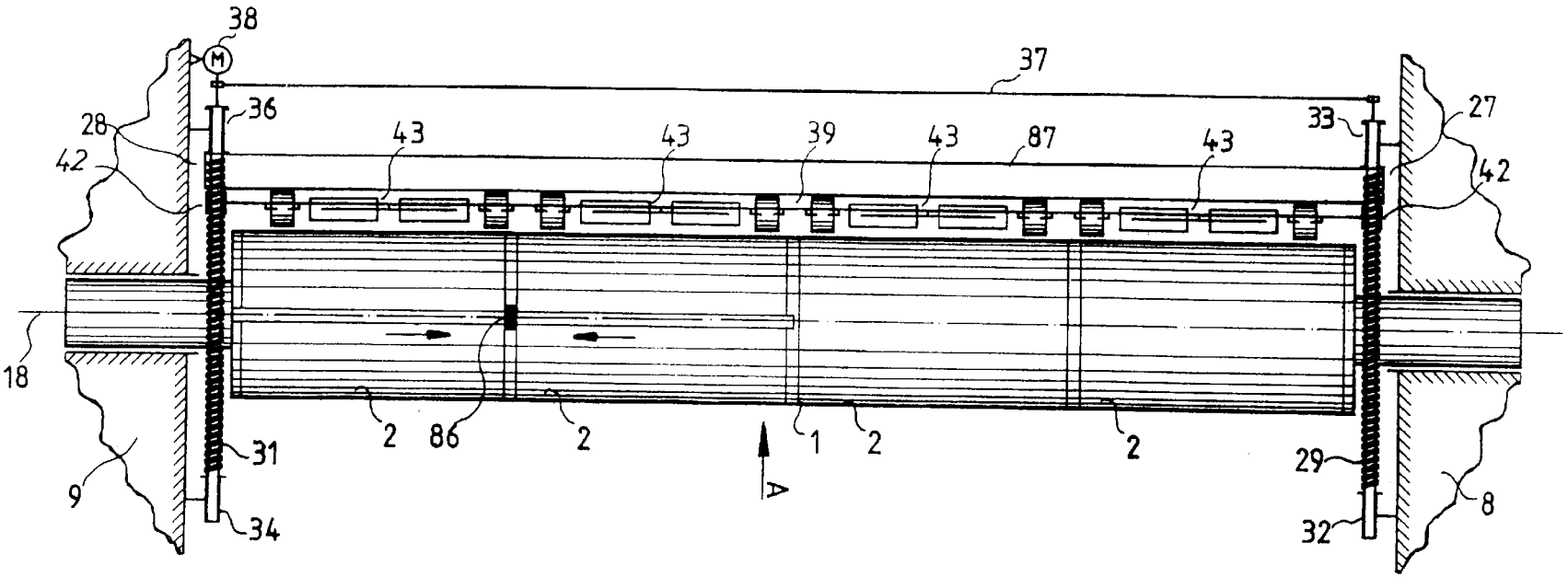
Fig. 1 PRIOR ART
FIG. 1 is a schematic top plan view of a device for mounting printing plates in accordance with the present invention.

Referring initially to FIG. 1, there may be seen a cylinder 1 of a rotary printing press in accordance with the present invention. The printing cylinder 1 is utilized to support a plurality of easily bendable, generally arcuately shaped objects 2, such as printing plates 2. As may be seen in FIG. 3, on the oppositely located leading and trailing ends of each easily bendable, arc-shaped object 2, there are provided front and rear suspension edges 3 and 4, respectively. These suspension edges 3 and 4 have respective legs 6 and 7 which each enclose an opening angle of less than 90°. These suspension edges 3 and 4 are dimensionally stable; i.e. during clamping of the objects 2 on the cylinder 1, these suspension edges 3 and 4 are not bent open. These objects 2 designed in this way as printing plates, can also consist of rubber blankets, which are provided with suspension edges 3 and 4. These dimensionally stable suspension edges 3 and 4 of the rubber blankets can be beveled edges of a metal plate, on which the rubber blanket is fastened by direct material contact, for example by being glued on or vulcanized. Fabric inlays, in particular of the rubber blanket, can be made of carbon fiber-reinforced plastic or of fiberglass-reinforced plastic, and the suspension edges 3 and 4 can be formed of this. For the sake of simplicity, this described object 2 will be called a printing plate 2 for the remainder of the description of the preferred embodiments.

An ink unit protector 11, which is positioned close to the cylinder and which is fixed in the frame, is embodied as a first printing plate preparation device 12, and is assigned to the cylinder 1 of the rotary printing press, which is seated between two lateral frames 8 and 9 as seen in FIG. 1. This first printing plate preparation device 12 has an upper wall 13 and a lower wall 14 that is located opposite the upper wall 13. These two walls 13 and 14 together constitute a chute 16. A suspension bar 19, which has a nose-shaped or angled cross section, and which extends across the width of the cylinder 1 and is parallel with an axis of rotation 18 of the cylinder 1, is fastened at an end 17, close to the plate cylinder, of the upper wall 13. The end 17, close to the plate cylinder, of the upper wall 13 is situated approximately parallel with a tangent 21, which is determined by a cylinder jacket surface 22 of the cylinder 1 and the suspension bar 19 of the printing plate preparation device 12. It is also possible to locate a second printing plate preparation device 23, besides the first printing plate preparation device 12, and whose end 24 close to the plate cylinder is also provided with a suspension bar 26 of a nose-shaped or angled cross section, and which is also situated approximately parallel with the tangent 21 determined by the cylinder jacket surface 22 of the cylinder 1 and the suspension bar 19 of the printing plate preparation device 12.

Again referring to FIGS. 1 and 3, above and parallel with this tangent 21 there is located one right and one left linear drive 27 and 28, respectively, and which drives 27 and 28 are fastened in the lateral frames 8 and 9, respectively. These linear drives 27 and 28 consist of threaded spindles 29 and 31 respectively, which are rotatably seated in brackets 32 and 33 or 34 and 36, that are fixed on the two lateral frames 8 and 9. In the same way, it is possible to employ other known linear drives 27 and 28, for example belt or chain drives, toothed rack drives, hydraulic or pneumatic servo cylinders or linear motors. A synchronous rotating movement of the two threaded spindles 29 and 31 is generated by means of a connecting belt 37, for example a toothed belt 37, which mechanically synchronizes the right and left threaded spindles 29 and 31. This synchronization can also take place, for example, mechanically by use of chain or universal joints, or electronically via two separate drives 38 of the linear drives 27 and 28. The two threaded spindles 29 and 31 move a cross-bar 39, which is positioned parallel with the axis of rotation 18 of the cylinder 1, in a conveying plane, which is located above and approximately parallel with the tangent 21 determined by the cylinder jacket surface 22 of the cylinder 1 and the suspension bar 19 of the printing plate preparation device 12. Threaded nuts 42 are respectively disposed at both ends of this cross-bar 39, so that the cross-bar 39 is in operative connection at right angles with the threaded spindles 29 and 31. At least one gripping and pressing device, generally at 43 is fastened along this cross-bar 39. In the embodiment depicted in FIG. 1, four such gripping and pressing devices 43 are fastened along the cross-bar 39.

An independently movable gripping and pressing device 43 is associated with each individual printing plate 2 assigned to an axial cylinder section. It is also possible, by means of an additional linear drive, by which a single gripping and pressing device 43 can perform an axial movement along the cross-bar 39, to exchange several printing plates 2 disposed along the cylinder 1 with only a single gripping and pressing device 43.

Figure 2:
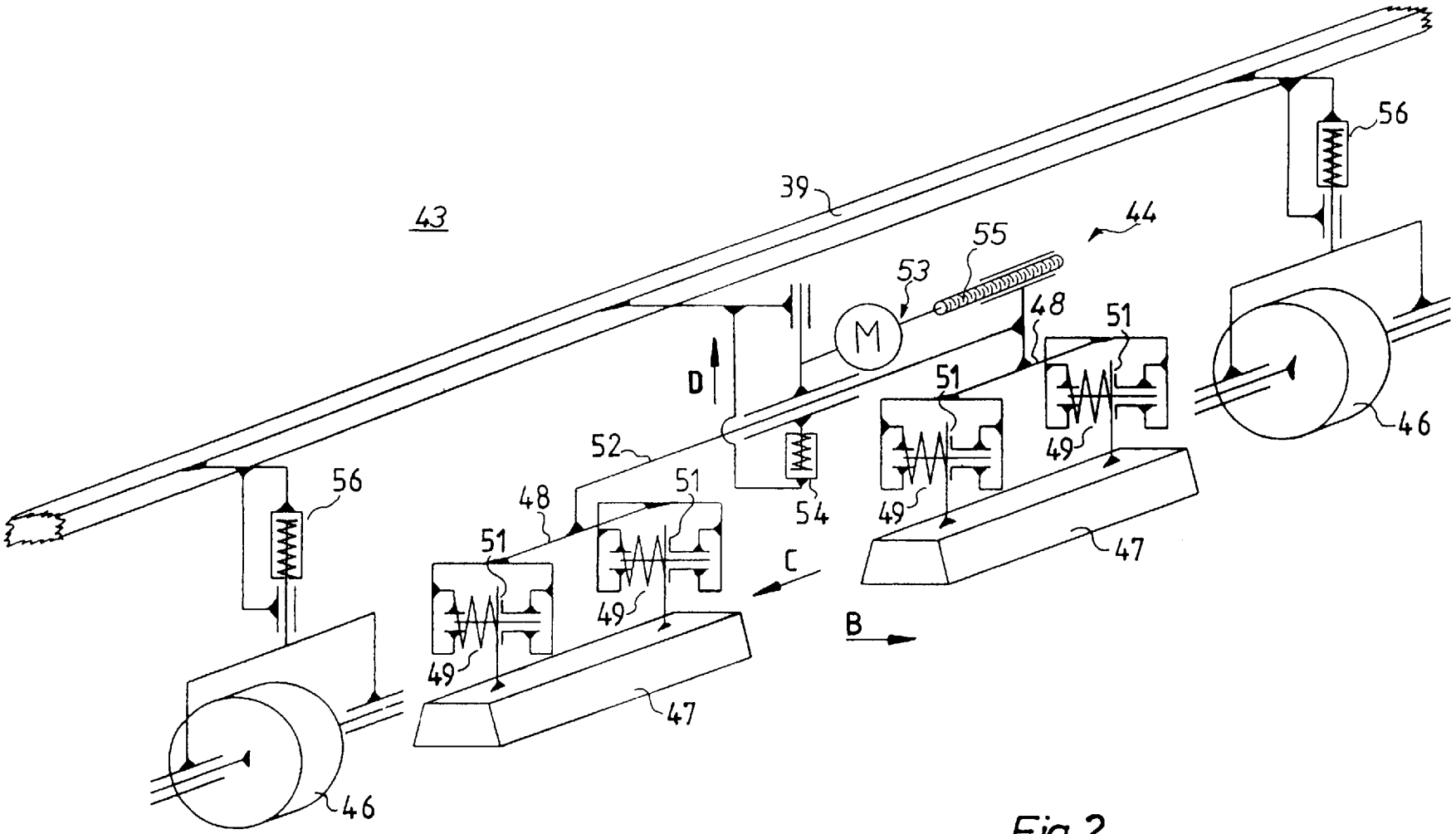
FIG. 2 is a schematic perspective representation of a gripping and pressing mechanism of the device of FIG. 1.

The elements of a gripping and pressing device 43 are depicted somewhat schematically in FIG. 2. Each gripping and pressing device 43 consists of at least one gripper unit 44 and at least one pressure roller 46. This gripper unit 44 and the pressure rollers 46 can be displaced, in relation to the cylinder 1, in the radial direction "D", and each gripper unit 44 can additionally be also displaced in an axial direction "C" of the cylinder 1, independently of each other. In the depicted embodiment, the gripping and pressing device 43 is arranged approximately symmetrically with respect to the center line of the printing plate 2 which extends in the direction of the cylinder circumference of the cylinder 1.

One gripper unit 44 is provided for each gripping and pressing device 43, and is fashioned in the shape of two suction bars 47, for example, which are axially displaceable, are fixed against relative rotation, perpendicularly in respect to a guide bar 48 opposite the tangential direction "b" of the cylinder 1, and which are pressed against a detent 51 in the direction "B" by means of pressure springs 49. These guide bars 48 are fastened on an upper guide bar 52 and can be displaced opposite the direction "C" by means of a positioning device 53. A pneumatic cylinder 54 causes a position change of the upper guide bar 52 and thus of the suction bars 47 along the direction "D". One pressure roller 46 is located next to each of the suction bars 47 and can be placed against the printing plate 2 opposite the direction "D" by means of a pneumatic cylinder 56. The positioning device 53 can be designed, for example, as a step motor with a threaded spindle 55. An electric motor with an incremental sensor or potentiometer cooperating with it is also possible. Therefore, means preferably cooperate with the positioning device 53 for detecting its position or the position of the printing plate 2.

In the subject invention, four plate end gripping assemblies or locks 57, 58, 59 and 61 are arranged in the cylinder 1 and extend in the axial direction, parallel with the axis of rotation 18 of the cylinder 1. These locks are disposed in cylinder pits or channels 62. The length of each of the respective locks 57, 58, 59 or 61 is approximately half the cylinder length. These locks 57, 58, 59 and 61 are each also divided in respect to the width of the plates; so that respectively two printing plates 2 are receivable by each lock 57, 58, 59 or 61, and each can be actuated independently of each other within this division as well as in respect to each other. The locks 57 and 58 are offset from each other by approximately 90° in the direction of the circumference of the cylinder 1. A lock 59 or 61 is respectively associated with a corresponding lock 57 or 58 on the opposite side of the cylinder 1.

Figure 3:
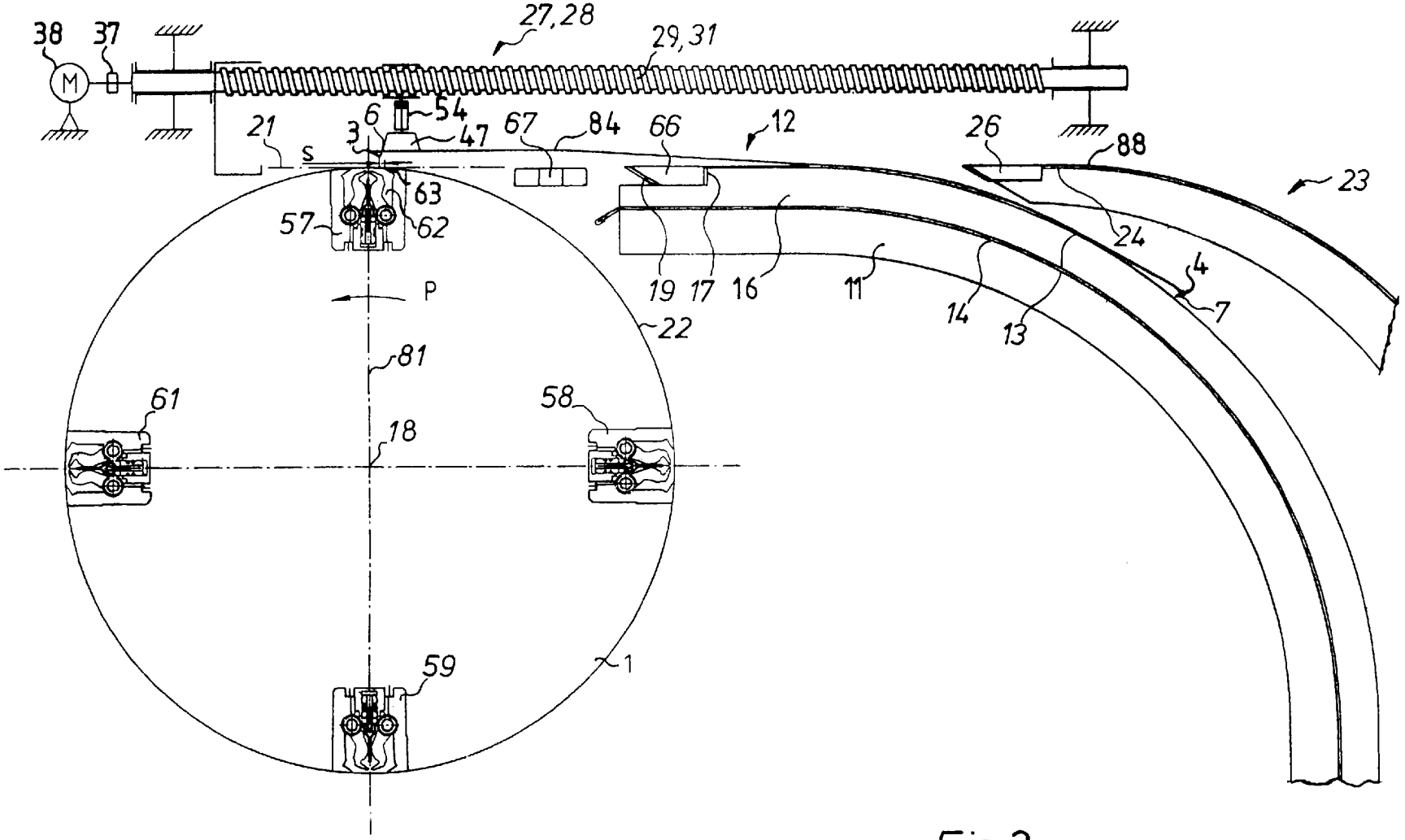
FIG. 3 is a schematic side elevation view of the device with the associated cylinder and preparation devices of FIG. 1.

For clamping a fresh printing place 84 in place, the cylinder 1 is rotated into a clamping position which, as seen in FIG. 3, is defined by the center line of the lock 57 being approximately congruent with a line 81 drawn from the axis of rotation 18 of cylinder 1 perpendicularly with the direction of the linear drives 27 and 28. The cross-bar 39 is brought into a position for receiving the fresh printing plate 84 by actuation of the two linear drives 27 and 28. The suction bars 47 are thereby located in the area of the end 17 of the upper wall 13, close to the plate cylinder, of the printing plate preparation device 12. The gripper unit 44 is displaced opposite to the direction "C" by actuating the positioning device 53.

The printing plate 84 which is to be applied to the cylinder 1 had been prepositioned and placed on the upper wall 13 and the suspension bar 19 of the printing plate preparation device 12. The suction bars 47 are lowered to the level of the printing plate 84 by venting the pneumatic cylinder 54 and are then charged with suction air. The print side of the printing plate 84 is gripped by the suction bars 47 and is fixed in place on the gripping and pressing device 43.

In accordance with the present invention, the axial alignment of a printing plate 84 is accomplished in the following manner. In a first preferred embodiment, each of a plurality of printing plates 84 which are placed axially next to each other, has been assigned at least two lateral register stops 66 and 86. At least one of these two lateral register stops 66 or 86 can be disposed directly on the suspension bar 19 of the printing plate preparation device 12, or separately in an area between the printing plate preparation device 12 and the cylinder 1, as shown in FIG. 3. In the simplest case, this one lateral register stop 66 of the two lateral stops 66 and 68 is disposed on the suspension bar 19 in addition to the lateral register stop 86 usually disposed on the cylinder 1. This lateral register stop 66 is laterally offset in the axial direction of the cylinder 1 and can be finely adjusted.

Figure 4:
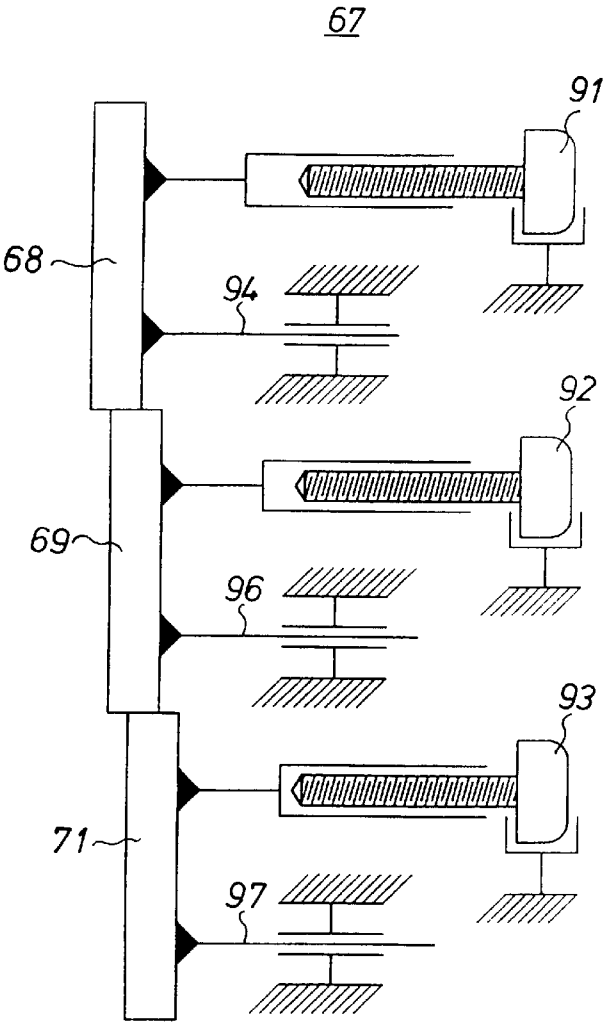
FIG. 4 is a schematic top view of a lateral register device in accordance with a second preferred embodiment.

In a second preferred embodiment, a lateral register stop 86 on the cylinder 1 is omitted. A lateral register arrangement 67 is disposed in the area between the printing plate preparation device 12 and the cylinder 1 and consists of three lateral register stops 68, 69 and 71, which are arranged behind each other, and which are disposed offset steplike in respect to each other in the axial direction of the cylinder 1, as may be seen in FIG. 4. These lateral register stops 68, 69 and 71 are embodied to be finely axially adjustable, for example, by means of threaded screws 91, 92 or 93 and a linear bearing 94, 96 or 97.

Figure 5:
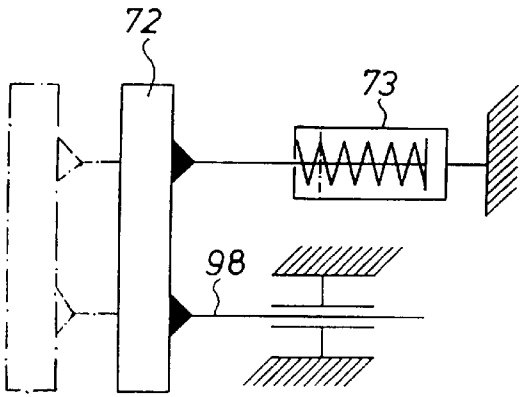
FIG. 5 is a schematic top view of an adjustable lateral register device in accordance with a third preferred embodiment.
Figure 6:
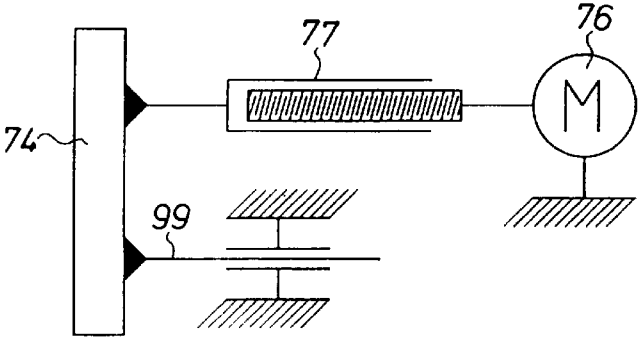
FIG. 6 is a schematic top view of an adjustable lateral register device in accordance with a fourth preferred embodiment.

In third and fourth preferred embodiments, only one lateral register stop 72 or 74 is displaceably disposed in a bearing 98 or 99, and can be placed into different positions which are offset in respect to each other in the axial direction of the cylinder 1. For example, the lateral register stop 72 can be fastened on a work cylinder 73, which is fixed in place, as depicted in FIG. 5. A piston of this work cylinder 73 moves the lateral register stop 72 into two positions. It is also possible to arrange a lateral register stop 74 continuously displaceable in the axial direction of the cylinder 1. To this end, the lateral register stop 74 can be positioned, for example, by means of a threaded spindle 77 which is driven by an electric motor 76, as illustrated in FIG. 6.

The printing plate 84 is axially aligned on the lateral register stops 66 to 69, 71, 72, 74 in the following manner. If, as discussed in connection with the first and second preferred embodiments, several lateral register stops 66 to 69, 71, 86 are arranged behind each other, the gripping and pressing device 43 with the gripped printing plate 84 approaches a preselected position assigned to the desired lateral register stops 66 to 69, 71, 86 in the direction "B", as shown in FIG. 2. With an adjustable lateral register stop 72 or 74, the lateral register stop 72 or 74 is brought into the preselected position by means of the work cylinder 73 or the electric motor 76. The gripper unit 44 with the gripped printing plate 84 moves in the direction "A" into a position assigned to the lateral register stop. The drive motor of the positioning device 53 moves the gripper unit 44 in the axial direction until the printing plate 84 is pressed with its suspension edge 3 against the respective lateral register stop 66 to 69, 71, 72, 74, 86. Subsequently, the motor for the positioning device 53 is switched off. This can take place, for example, by a limitation of the current reception of an electrically driven motor of the positioning device 53, or it is possible to dispose a sensor in the area of the power flow for detecting the pressure force. In the same way, it is possible to determine criteria for switch-off from the relationship between the path travelled by the printing plate 84 or of the positioning device 53 and the time needed for this.

In place of the lateral register stops 66 to 69, 71, 72, 74 and 86, it is also possible to provide sensors for detecting the position of the printing plate 84. A CCD sensor is particularly suited for determining the position of the printing plate 84 and for controlling the positioning drive of the gripper unit 44. This CCD sensor can be advantageously fastened so it is partially covered by the lateral edge of the printing plate and fixed in place in relation to the lateral frame. In the process, the CCD sensor is aligned by being associated with a defined position of the cylinder 1.

After the gripper unit has gripped the printing plate 84, the initial position of the printing plate 84 is determined by means of the CCD sensor. The drive of the positioning device 53 is operated, based on this initial position, until the printing plate 84 has reached the desired position in respect to the CCD sensor and therefore in respect to the cylinder 1. Now the drive motor of the positioning device 53 is switched off and the printing plate 84 is transported in the direction toward the cylinder 1.

A further preferred embodiment, not represented, has two sensors on the gripping and pressing device 43 and a reference point on the cylinder 1 for determining the position. The first sensor, which detects a lateral edge of the printing plate 84, is fastened on the cross-bar 39 in the area of a lateral edge of the printing plate 84. The second sensor, which detects the reference point, is arranged, movable with the gripper unit 44, in the area of the reference point located on the cylinder 1.

The gripper unit 44, with the second sensor, is moved in the axial direction until the reference point of the cylinder 1 has been reached. This reference position is stored by the control of the drive motor of the positioning device 53. If, in the course of this movement, the position of the lateral edge of the printing plate 84 has been detected, this position is also stored. Otherwise, the printing plate 84 is axially displaced further until the lateral edge of the printing plate 84 is detected. Based on these two position values and a preselected position in which the printing plate 84 is intended to be mounted, the control of the drive motor of the positioning device 53 calculates a path by which the printing plate 84 still needs to be displaced. Subsequently the positioning device 53 performs the required axial movement of the printing plate 84.

Finally, in a further preferred embodiment, not shown, the reference point is embodied on the cylinder 1 as a stop for a lateral edge of the printing plate 84. The printing plate 84 suspended in the suspension edge 63 of the cylinder 1, whose plate front suspension edge 3 is held by the gripper device 44, is guided in the axial direction against the stop by means of the positioning device 53. When the suspension edge 3 meets the stop, the motor for the positioning device 53 is switched off. This switch-off can occur, for example, by means of a current limiter or by evaluation of the pulse sequences of an incremental sensor. Starting from this reference position, the printing plate 84 is positioned in the axial direction in the preselected position of the cylinder 1 by means of the positioning device 53.

Further mounting of the plate 84 of the cylinder can take place, for example, in accordance with the process described in German Patent Publication DE 44 24 931 A1, which corresponds to U.S. patent application Ser. No. 08/669,391, filed Jul. 17, 1996, the disclosure of which is incorporated herein by reference.

If several printing plates can be mounted on a cylinder in the axial direction next to each other in assigned cylinder sections, at least one cylinder section has several selectable set positions located next to each other. Several selectable set positions are assigned to each cylinder section to which a printing plate is assigned. The "rough position" of the plate is therefore determined by the selection of the cylinder section. The "fine position" within the cylinder section is determined by the selection of a set position from several set positions which are located next to each other.

While preferred embodiments of a method and apparatus for axially positioning a printing plate in accordance with the present invention have been set forth fully and completely hereinabove, it will be apparent to one of skill in the art that a number of changes in, for example, the size of the cylinder, the type of plate secured to the cylinder and the like can be made without departing from the true spirit and scope of the present invention which is accordingly to be limited only by the following claims.

What is claimed is:

1. A method for axially positioning a printing plate while it is being conveyed to a cylinder of a rotary printing press comprising:

providing a printing plate preparation device;

providing a printing plate conveying assembly;

using said printing plate conveying assembly to convey said printing plate to said cylinder from said printing plate preparation device;

providing a plurality of preselectable axially adjoining set positions on said cylinder;

selecting one of said set positions from said plurality of set positions;

determining a position of said printing plate in the axial direction of said cylinder in relation to a reference position on said cylinder;

providing at least one printing plate lateral register stop remote from said cylinder;

using said printing plate conveying assembly to move a lateral edge of said printing plate into engagement with said at least one remote lateral register stop during conveying of said printing plate to said cylinder; and bringing said printing plate to said preselected set position on said cylinder.

2. The method of claim 1 further including determining an initial axial position in the axial direction of said cylinder and bringing said printing plate from said initial axial position to said reference position.

3. The method of claim 1 further including providing an axial positioning device in said printing plate conveying assembly for bringing said printing plate to said set position on said cylinder, determining an initial position of said axial positioning device, determining a displacement path required to bring said plate to said set position, and operating said axial positioning device to move said printing plate along said displacement path.

4. The method of claim 3 further including halting operation of said axial positioning device upon said printing plate reaching said preselected set position.

5. An apparatus for the axial positioning of a printing plate on a peripheral surface of a plate cylinder of a rotary printing press comprising:

a printing plate preparation device situated adjacent the plate cylinder;

a printing plate conveying device for use in conveying said printing plate from said printing plate preparation device to the plate cylinder;

at least one printing plate lateral register stop positioned remote from the plate cylinder;

means on said printing plate conveying device for shifting said printing plate axially with respect to said plate cylinder to engage a lateral edge of said printing plate with said at least one remote register stop during conveying of said printing plate from said printing plate preparation device to the plate cylinder; and means for positioning said printing plate on the cylinder in a position selected from several axially adjoining positions on the cylinder.

6. The apparatus of claim 5 wherein said means on said printing plate conveying device for shifting said printing plate axially is an axial positioning device, and further including means for recognizing a position of said axial positioning device.

7. The apparatus of claim 5 wherein each of said axially adjoining positions on the cylinder is provided with at least one stop.

* * * * *